US008171698B2

(12) United States Patent
Neuhofer jun.

(10) Patent No.: US 8,171,698 B2
(45) Date of Patent: May 8, 2012

(54) APPARATUS FOR FASTENING A FINISHING STRIP

(76) Inventor: Franz Neuhofer jun., Zell am Moos (AT)

( * ) Notice: Subject to any disclaimer, the term of this patent is extended or adjusted under 35 U.S.C. 154(b) by 0 days.

(21) Appl. No.: 12/586,594

(22) Filed: Sep. 24, 2009

(65) Prior Publication Data

US 2010/0071288 A1 Mar. 25, 2010

(30) Foreign Application Priority Data

Sep. 25, 2008 (AT) ..... A 1495/2008

(51) Int. Cl.
*E04C 2/38* (2006.01)

(52) U.S. Cl. ..... 52/718.06; 52/287.1; 52/290; 52/716.8

(58) Field of Classification Search ..... 52/287.1, 52/288.1, 290, 506.05, 255, 631, 716.1, 716.8, 52/718.01, 718.04, 718.06, 717.03
See application file for complete search history.

(56) References Cited

U.S. PATENT DOCUMENTS

| | | | | |
|---|---|---|---|---|
| 3,298,147 | A * | 1/1967 | Haberman | 52/288.1 |
| 6,115,982 | A | 9/2000 | Lindenberg | |
| 6,381,915 | B1 * | 5/2002 | Wood | 52/718.06 |
| 6,505,448 | B2 * | 1/2003 | Ito | 52/474 |
| 6,560,944 | B1 * | 5/2003 | Wilson | 52/717.01 |
| 6,643,987 | B2 * | 11/2003 | Rusch et al. | 52/506.05 |
| 7,574,836 | B2 | 8/2009 | Wesolowska | |
| 7,594,368 | B2 * | 9/2009 | Kurz | 52/290 |
| 2003/0140583 | A1 * | 7/2003 | Sauter | 52/220.7 |
| 2004/0168384 | A1 * | 9/2004 | Wesolowska | 52/287.1 |
| 2008/0034688 | A1 | 2/2008 | Neuhofer, Jr. | |
| 2009/0044469 | A1 * | 2/2009 | Kurz | 52/290 |

FOREIGN PATENT DOCUMENTS

| | | |
|---|---|---|
| AT | 503 228 | 8/2007 |
| DE | 93 01 324 | 5/1993 |
| DE | 297 16 146 | 1/1998 |
| DE | 101 07 866 | 9/2001 |
| EP | 0 560 748 | 9/1993 |
| WO | WO 02/066764 | 8/2002 |

* cited by examiner

*Primary Examiner* — William Gilbert
*Assistant Examiner* — Alp Akbasli
(74) *Attorney, Agent, or Firm* — Collard & Roe, P.C.

(57) ABSTRACT

An apparatus is described for fastening a finishing strip (2) with a support (1) forming a wall leg (4), which support comprises at least one upwardly protruding holding web (8) engaging in a downwardly open groove (9) of the finishing strip (2) for clamping accommodation of the finishing strip. In order to enable securing the finishing strip (2) in the mounting position it is proposed that the support (1) comprises at least one resilient securing tongue (10) with a leg extending approximately parallel to the holding web (8), which securing tongue overlaps a securing stop (12) of the finishing strip (2) which extends transversally to the holding web (8).

8 Claims, 5 Drawing Sheets

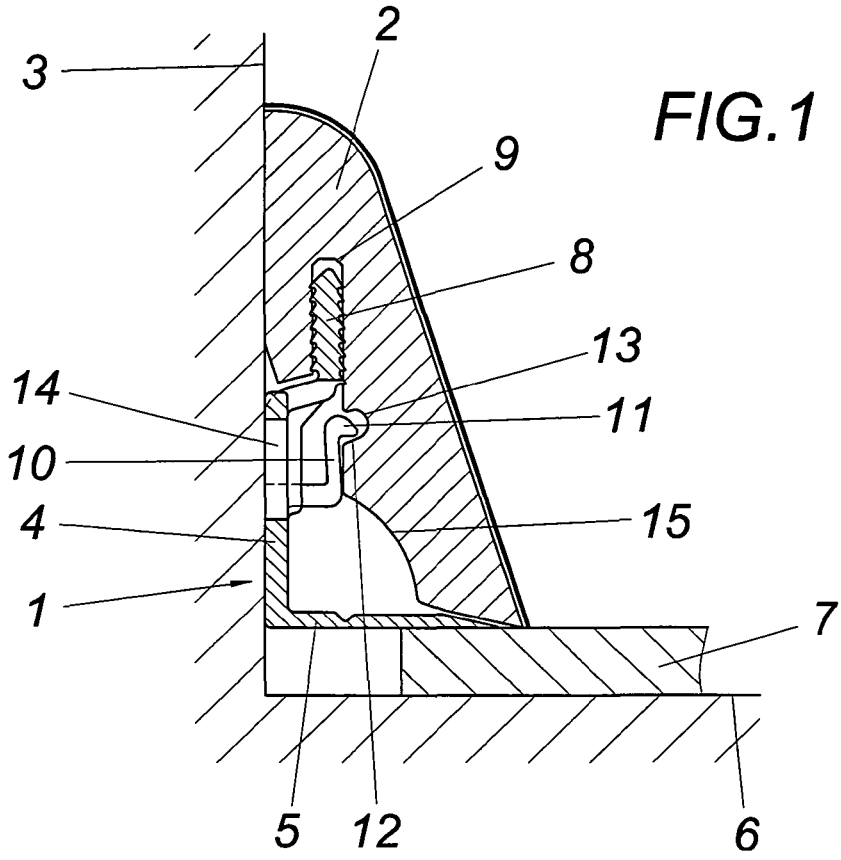
FIG.1
FIG.2
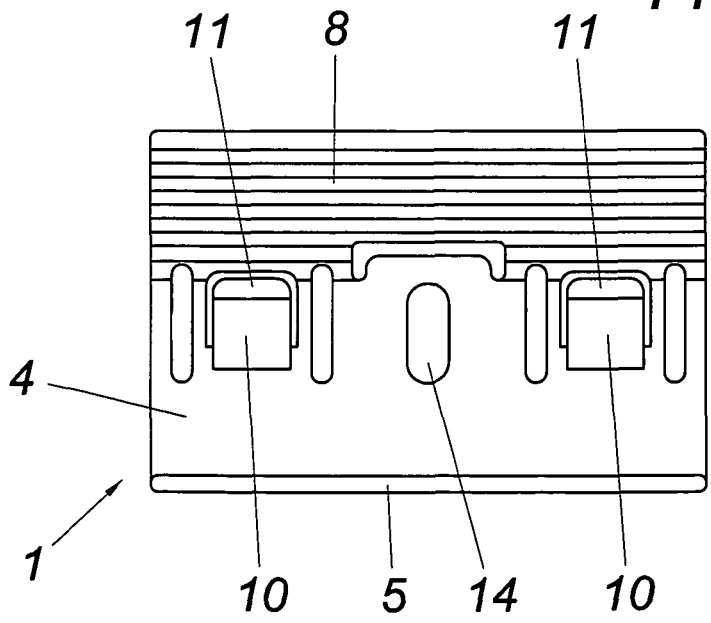

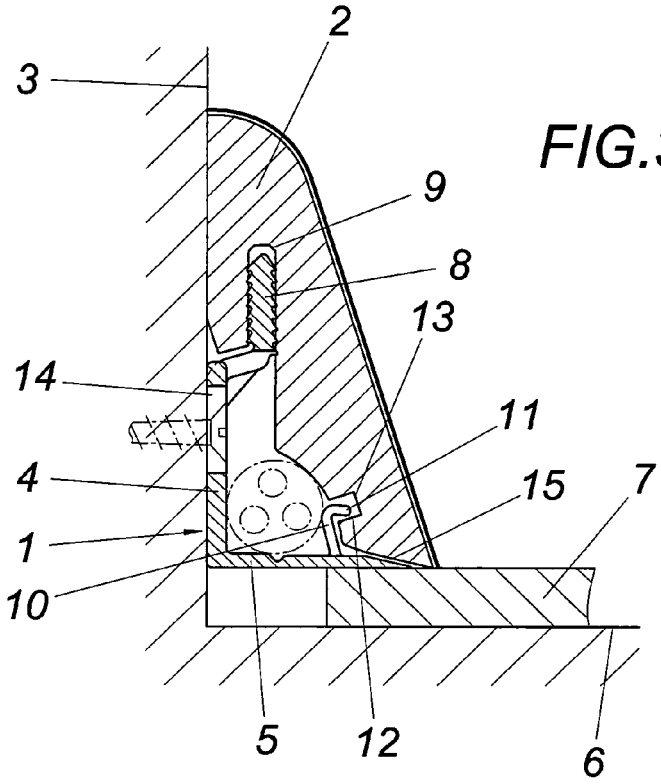
FIG.3
FIG.4
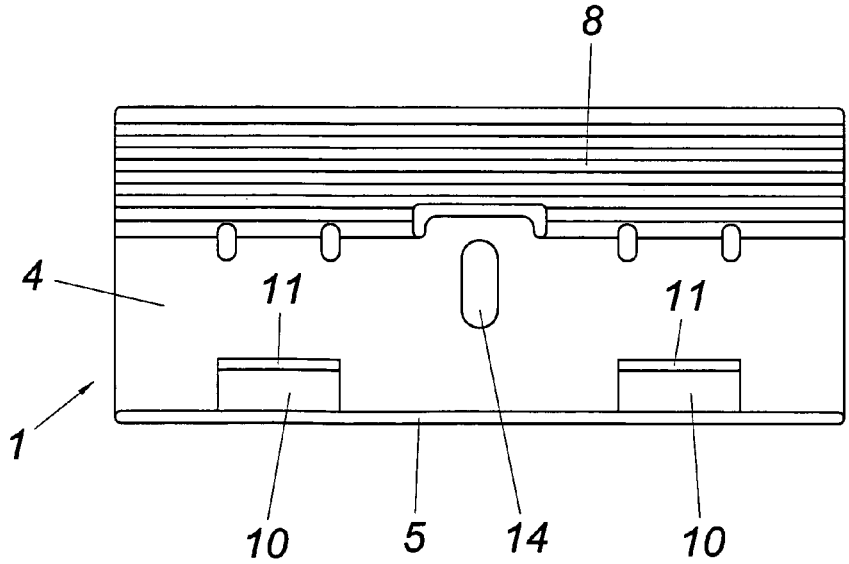

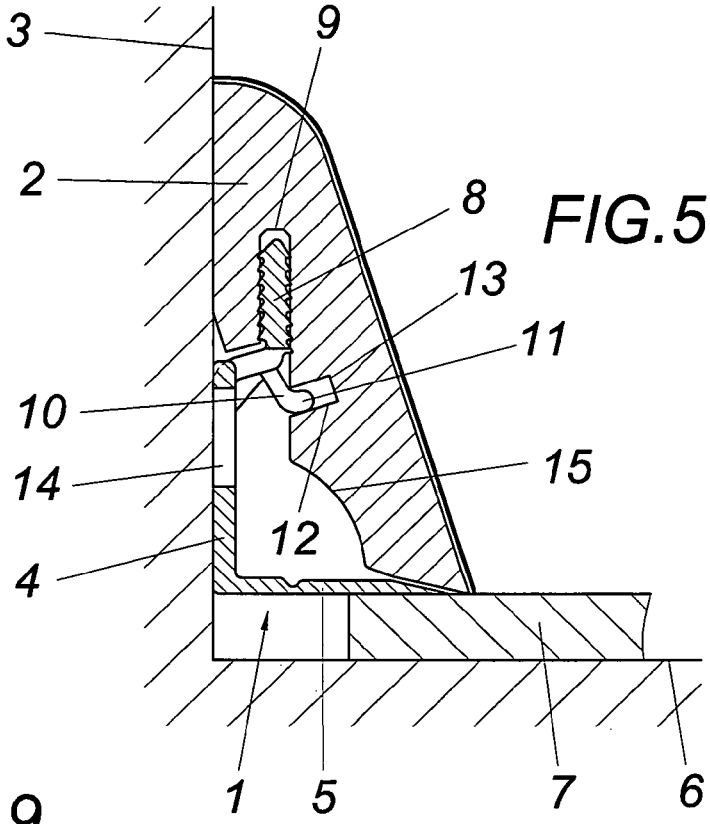
FIG.5
FIG.9
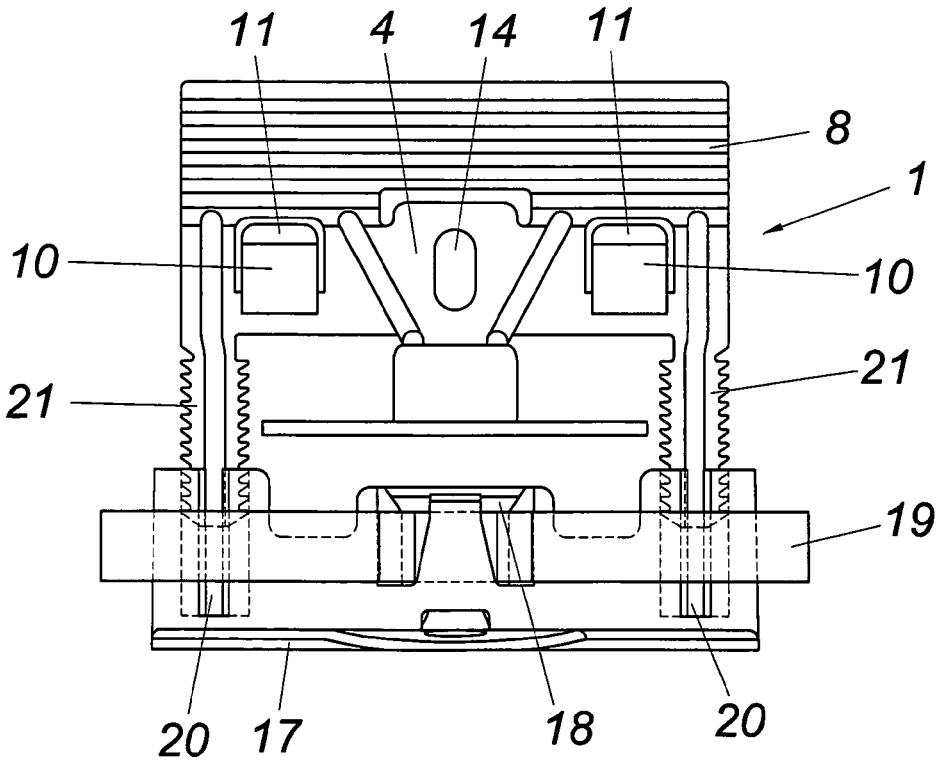

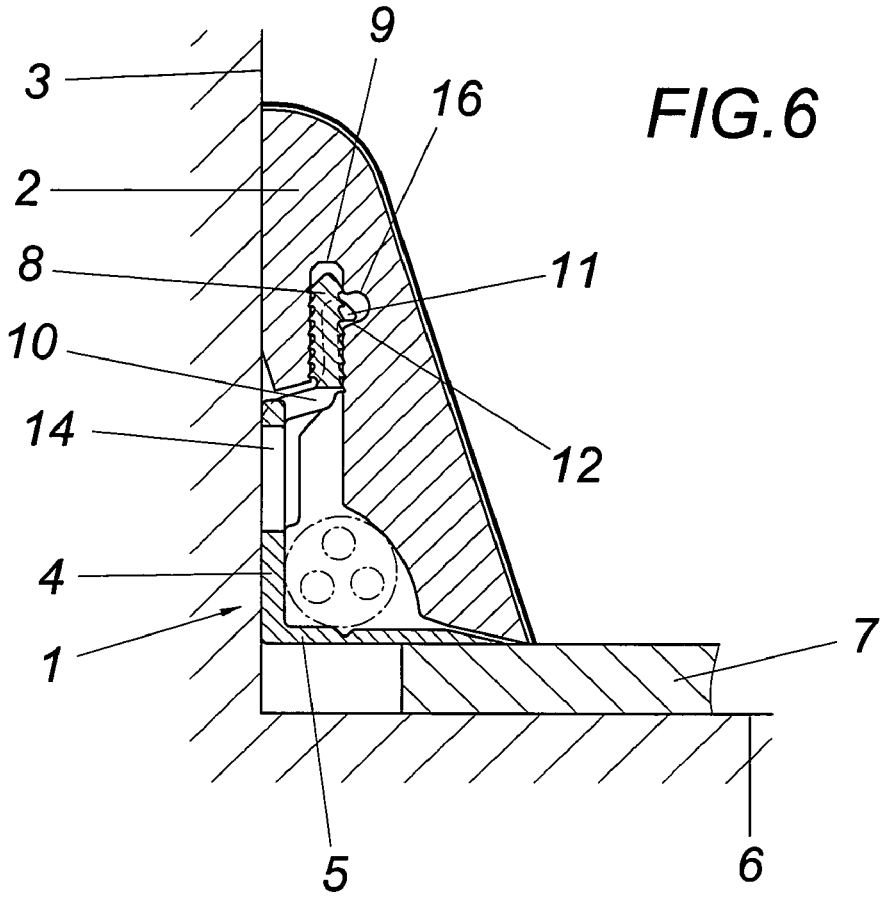
FIG.6
FIG.7
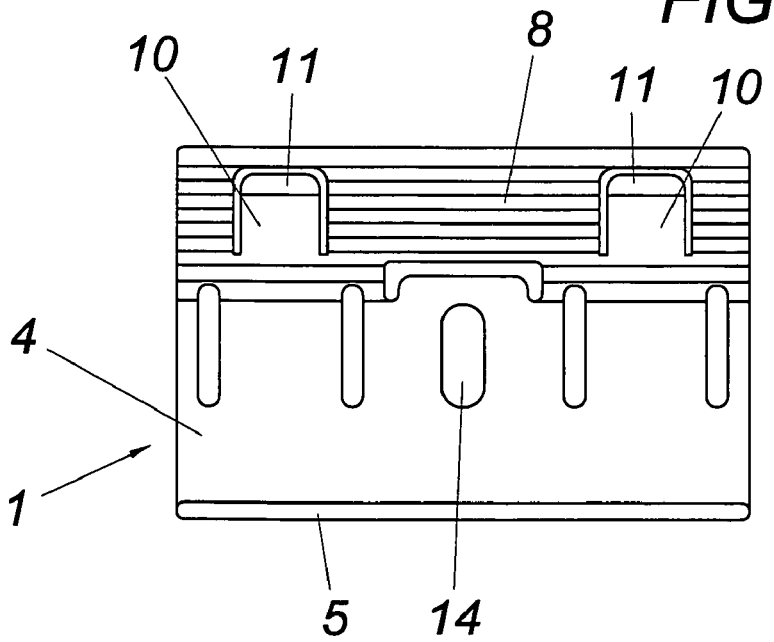

3
2
9
8
14
13
10
11
1
12
4
15
21
5
7
18
17
19
6

APPARATUS FOR FASTENING A FINISHING STRIP

CROSS REFERENCE TO RELATED APPLICATIONS

Applicant claims priority under 35 U.S.C. §119 of Austrian Application No. A 1495/2008 filed on Sep. 25, 2008.

FIELD OF THE INVENTION

The invention relates to an apparatus for fastening a finishing strip with a support forming a wall leg, which support comprises at least one upwardly protruding holding web engaging in a downwardly open groove of the finishing strip for clamping accommodation of the finishing strip.

DESCRIPTION OF THE PRIOR ART

In order to fasten finishing strips between a wall and an adjoining floor covering it is common practice to provide supports on the wall which comprise holding webs which engage in grooves of the finishing strip, so that the finishing strip merely needs to be attached to said holding webs. Said holding webs can be provided with different configurations and determine the direction of attachment for the finishing strip through their orientation. When the support forms a support leg that can be placed on the floor covering and a wall leg with an upwardly protruding holding web to which the finishing strip is attached parallel to the wall (WO 02/066764 A2), this will lead to the advantage that the finishing strip will always rest on the wall, especially in cases where the finishing strip is pressed via the holding web under resilient pretensioning against the wall. There is a likelihood however that a gap will be produced between the floor covering and the finishing strip, which occurs in cases where the finishing strip is not attached completely to the holding web or the clamping receptacle of the finishing strip will become loose and the finishing strip will be displaced along the holding web engaging in the groove.

In order to support finishing strips with the help of holding element which can be fastened to the wall with a distance it is further known (DE 101 07 866 A1) to provide the holding elements with two resilient boundary tongues which are swivelable against one another against spring force and comprise catch hooks which are averted from one another and engage in snap-in grooves of the finishing strip, so that the finishing strip is held between resilient boundary tongues under elastic pretension during the latching of the catch hooks in the undercut catch grooves. As a result of the alignment of the undercuts of the catch grooves of the finishing strip, it is ensured in connection with the resilient pressuring of the finishing strip by the boundary tongues that the finishing strip is pressed both against the wall as well as against the floor. An additional middle resilient tongue can be used to amplify the pressing force against the floor or the wall or to predetermine the distance of the finishing strip from the wall. This known apparatus for fastening a finishing strip excludes a holding web predetermining the direction of attachment for clamping accommodation of the finishing strip.

SUMMARY OF THE INVENTION

The invention is thus based on the object of arranging a support of the kind mentioned above for a finishing strip in such a way that a secure contact of the finishing strip on the wall and on the floor covering can be ensured.

This object is achieved by the invention in such a way that the support comprises at least one resilient securing tongue with a leg extending approximately parallel to the holding web, which securing tongue overlaps a securing stop of the finishing strip which extends transversally to the holding web.

Since the securing tongue will overlap the securing stop of the finishing strip in the mounting position of the finishing strip during the attachment of the finishing strip to the holding web, any unintentional withdrawal of the finishing strip from the holding web of the wall leg is no longer possible because the securing tongue supported on the securing stop of the finishing strip will counteract this withdrawal as a result of the alignment of the securing stop transversally to the direction of withdrawal, which means transversally to the holding web and transversally to the wall. As a result, the position of the finishing strip is fixed in relation to the support by two holding elements which act substantially transversally to the wall and transversally to the floor, thus ensuring the contact of the finishing strip with the wall on the one hand and the floor covering on the other hand under the precondition of a proper displacement of the support. This obviously also applies to embodiments in which the support comprises two holding webs which engage in a common groove or in separate grooves.

The overlapping of the securing stop extending transversally to the holding web by the resilient securing tongue leads to a resilient yielding of the securing tongue along a run-up surface formed by the finishing strip during the attachment of the finishing strip to the holding web. This yielding is ensured in a simple manner in such a way that the resilient securing tongue comprises a leg which extends approximately parallel to the holding web and which can be bent out in a resilient manner about an axis extending in its longitudinal direction in order to be bent out along the run-up surface and to then overlap the securing stop. This overlap can preferably occur by means of a latching nose which is arranged at the free end of the leg of the securing tongue which extends parallel to the holding web.

Since it is merely relevant that the resilient securing tongue overlaps a securing stop which extends transversally to the holding web, different constructional embodiments are possible in order to achieve this goal. Simple preconditions for construction are obtained when the resilient securing tongue is provided on the wall leg. Securing tongues provided on the wall leg might impair the clearance between the finishing strip and the support which is provided for laying cables or lines for example. In order to ensure that this clearance can be used substantially for laying lines, the resilient securing tongue can be provided on a support leg of the support which can be placed on a floor covering. The securing tongue can also be arranged on the holding web itself, thus requiring respective securing stops in the region of the clamping receptacle of the finishing strips for the holding web. Although the securing means against withdrawal which is provided in the region of the clamping receptacle does not provide any additional advantage concerning the support of the finishing strips because the holding web and the securing tongue are effective in direct vicinity of each other, this measure can still ensure that the clearance obtained between wall, floor covering and finishing strip can be utilized in an unobstructed manner.

Although the securing stop of the finishing strip extending transversally to the holding web can be formed by an inwardly protruding shoulder for securing against withdrawal, advantages are obtained concerning the additional support of the finishing strip when the finishing strip comprises a groove forming a securing stop in which the securing stop is accommodated in a preferably interlocking manner.

As has already been indicated, the laying of the finishing strip depends on the proper offset of the support in relation to the clamping receptacle of the finishing strip. In order to enable simple mounting conditions in this connection which allow laying without the use of any tools, the support can be held to be height-adjustable in a part of the floor by gripping beneath the floor covering, which floor part comprises a receptacle for a leaf spring resting under pretension on the face side of the floor covering. The floor part which is overlapped by the floor covering and is thus fixed to the floor which accommodates the floor covering is pressed against the wall by the leaf spring which rests on the face side of the floor covering under pretension, so that the support which is held in a height-adjustable manner in relation to said floor part will also rest on the wall. The adjustability in height of the support allows a simple adjustment to the respective thickness of the floor covering when the support is introduced into the floor part up to the stop of its support leg on the floor covering and will preferably latch in the respective engagement position. The finishing strip then only needs to be attached in the illustrated manner to the support.

BRIEF DESCRIPTION OF THE DRAWINGS

The subject matter of the invention is shown in the drawings, wherein:

FIG. 1 shows a simplified sectional view of an apparatus in accordance with the invention for fastening a finishing strip;

FIG. 2 shows the support for the finishing strip according to FIG. 1 in a front view;

FIG. 3 shows a constructional variant corresponding to FIG. 1;

FIG. 4 shows the support for the finishing strip according to FIG. 3 in a front view;

FIG. 5 shows a further embodiment of a fastening apparatus in accordance with the invention in a sectional view;

FIG. 6 shows a further embodiment of a fastening apparatus in accordance with the invention in a simplified sectional view;

FIG. 7 shows the support for the finishing strip according to FIG. 6 in a front view;

FIG. 9 shows the support of FIG. 8 in a front view.

DESCRIPTION OF THE PREFERRED EMBODIMENTS

Figure 8:
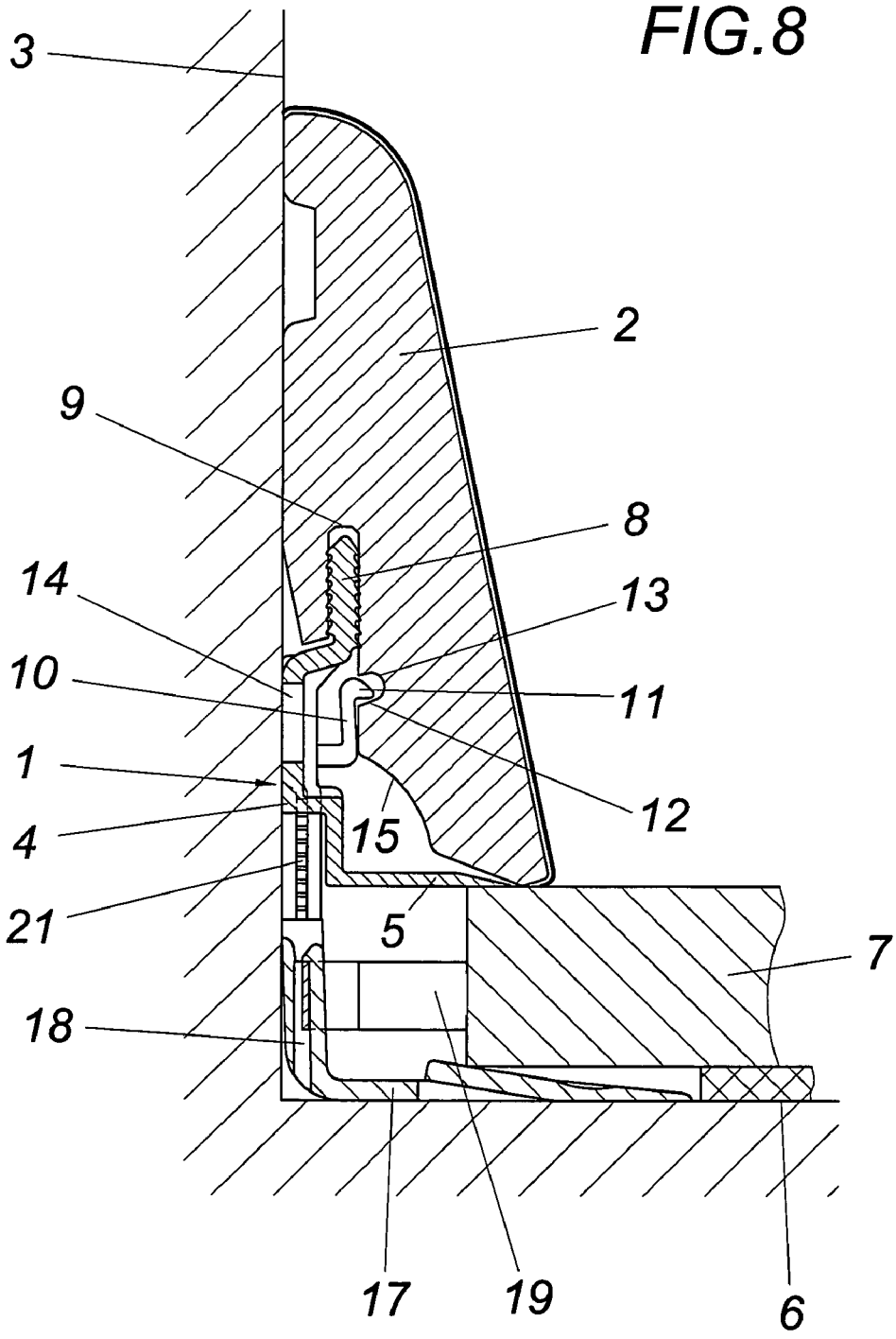
FIG. 8 shows an additional constructional variant of an apparatus in accordance with the invention in a simplified sectional view.

In accordance with FIGS. 1 and 2, the support 1 for a finishing strip 2 comprises a wall leg 4 which can be fastened to a wall 3 and a support leg 5 which protrudes from the same and rests on a floor covering 7 laid on the floor 6. The wall leg 4 forms a bent-off toothed holding web 8 which protrudes upwardly and which cooperates with a downwardly open groove 9 of the finishing strip 2. In contrast with conventional supports of this kind, the support 4 forms two additional securing tongues 10 which overlap a securing stop 12 of the finishing strip 2 with a hook-like latching nose 11, as is shown in FIG. 1. Said securing stop 12 can be formed by a wall of a groove 13. This is not mandatory however because it is merely relevant that the inadvertent withdrawal of the finishing strip 2 from the holding web 8 is prevented, for which purpose a securing stop 12 is required which extends transversally to the holding web 8 and which is overlapped by the securing tongue 10.

After fastening the support 1 to wall 3, preferably with the help of screws, for which oblong holes 14 are provided in the wall leg 4, the finishing strip 2 can be attached to the holding web 8 parallel to the wall, with the resilient securing tongues 10 being swiveled out via a run-up surface 15 which is formed by the finishing strip 2 in order to overlap the securing stop 12 in the illustrated mounting position. The finishing strip 2, which is subjected to a conventional clamping support via the holding web 8 in groove 9, is thus secured against inadvertent withdrawal from the holding web 8 by the resilient securing tongues 10 and is provided with additional support by the securing tongues 10, so that the contact of the finishing strip 2 both on the wall 3 as well as the floor covering 7 is ensured.

The embodiment according to FIG. 3 differs from the one according to FIG. 1 especially by the arrangement of the securing tongues 10 which are not provided on the wall leg 4 but on the support leg 5. As a result of the arrangement of the securing tongues 10 in the region of the support leg 5, a sufficient clearance for laying a cable or a line remains between the support 1 and the finishing strip 2, as is indicated in FIG. 3 with a dot-dash line. Accordingly, the groove 13 in the finishing strip 2 which forms the securing stop 12 is also displaced. The function of the securing tongues 10 is maintained because they prevent the withdrawal of the finishing strip 2 from the holding web 8 by resting on the securing stop 12.

In accordance with FIG. 5, a comparable clearance for laying a cable or a line is created in such a way that the leg of the securing tongues 10 which extend approximately in the direction of the holding web 8 protrudes downwardly in the opposite direction in relation to the holding web 8 from the bent-off portion for the holding web 8 and engages with the latching nose 11 into the groove 13. This kind of securing of the finishing strip 2 renders impossible any detachment of the finishing strip 2 from the holding web 8 without breaking the securing tongues 10.

In the embodiment according to FIGS. 6 and 7, the resilient securing tongues 10 are arranged on the holding web 8 itself and engage with their latching nose 11 in a widened portion 16 of the groove 9 accommodating the holding web 8, thus obtaining a securing stop 12 which extends transversally to the holding web 8. Although the securing tongues 10 prevent any inadvertent withdrawal of the finishing strip 2 from the holding web 8, they can hardly contribute towards better support and fixing of the finishing strip 2.

In order to avoid having to screw the support 1 on wall 3, a floor part 17 which accommodates the support 1 is provided in the embodiment according to FIGS. 8 and 9, which floor part grasps beneath the floor covering 7 and is therefore held on the floor 6 by the floor covering 7. The floor part 17 is pressed against the wall 3 by means of a leaf spring 19 which is inserted into a receptacle 18 and which rests on the face side of the floor covering 7 under pretension. The floor part 17 forms insert guides 20 for insert noses 21 on either side of the receptacle 18 for the leaf spring 19, which insert noses downwardly extend the wall leg 4 of the support 1 and form toothed strips in order to achieve a clamping seat within the insert guides 20 which is sufficient against inadvertent withdrawing of the support 1. The support 1 is inserted with its insert noses 21 into the insert guides 20 up to the placement of the support leg 5 on the floor covering 7, through which the fastening of the support 1 is completed. It is merely necessary to slide the finishing strip 2 onto the holding web 8, with securing tongues 10 preventing the inadvertent withdrawal of the finishing strip 2 from the holding web 8. The securing tongues 10 are arranged in this embodiment in the region of the wall leg 4, as is shown in FIG. 8.

The invention claimed is:

1. An apparatus comprising a finishing strip and a support forming a wall leg, which support comprises at least one upwardly protruding holding web engaging in a downwardly open groove of the finishing strip for clamping accommodation of the finishing strip, wherein the support comprises at least one resilient securing tongue with a leg extending approximately parallel to the holding web, which securing tongue overlaps a securing stop of the finishing strip which extends transversally to the holding web, and wherein a clearance space is provided between the securing tongue and the wall leg for resilient deflection of the securing tongue away from the securing stop while the finishing strip is set onto the at least one upwardly protruding holding web.

2. The apparatus according to claim 1, wherein the leg of the securing tongue extending approximately parallel to the holding web carries a latching nose which overlaps the securing stop.

3. The apparatus according to claim 1, wherein the resilient securing tongue is provided on the wall leg.

4. The apparatus according to claim 1, wherein the resilient securing tongue is provided on a support leg of the support which can be placed on a floor covering.

5. The apparatus according to claim 1, wherein the resilient securing tongue is provided on the holding web.

6. The apparatus according to claim 1, wherein the finishing strip comprises a groove forming the securing stop.

7. The apparatus according to claim 1, wherein the support is held to be height-adjustable in a floor part gripping beneath the floor covering, which floor part comprises a receptacle for a leaf spring resting under pretension on the face side of the floor covering.

8. The apparatus according to claim 1, wherein the finishing strip has a run-up surface underneath the securing stop for resilient deflection of the securing tongue.

* * * * *